US007027003B2

(12) United States Patent
Sasaki et al.

(10) Patent No.: US 7,027,003 B2
(45) Date of Patent: Apr. 11, 2006

(54) PRIMARY RADIATOR FOR PARABOLIC ANTENNA

(75) Inventors: Masatoshi Sasaki, Chofu (JP); Tomoyuki Mori, Chofu (JP); Kenji Obinata, Chofu (JP)

(73) Assignees: SPC Electronics Corporation, Tokyo (JP); Funai Electric Co., Ltd., Osaka (JP)

( * ) Notice: Subject to any disclaimer, the term of this patent is extended or adjusted under 35 U.S.C. 154(b) by 9 days.

(21) Appl. No.: 10/843,244

(22) Filed: May 11, 2004

(65) Prior Publication Data

US 2004/0227686 A1 Nov. 18, 2004

(30) Foreign Application Priority Data

May 13, 2003 (JP) ..... 2003-134144
Apr. 8, 2004 (JP) ..... 2004-114523

(51) Int. Cl.
*H01Q 13/00* (2006.01)

(52) U.S. Cl. ..... 343/786; 343/772

(58) Field of Classification Search ..... 343/786, 343/772, 775, 779
See application file for complete search history.

(56) References Cited

U.S. PATENT DOCUMENTS

| | | | | |
|---|---|---|---|---|
| 4,122,446 | A * | 10/1978 | Hansen | 343/786 |
| 5,642,121 | A * | 6/1997 | Martek et al. | 343/786 |
| 5,767,815 | A * | 6/1998 | Krebs | 343/786 |
| 6,023,246 | A * | 2/2000 | Tanabe | 343/753 |
| 6,163,304 | A * | 12/2000 | Peebles et al. | 343/786 |
| 6,501,432 | B1 | 12/2002 | Yuanzhu | 343/772 |
| 2002/0196194 | A1 * | 12/2002 | Lier | 343/786 |
| 2003/0117332 | A1 * | 6/2003 | Hirota et al. | 343/786 |
| 2003/0222828 | A1 * | 12/2003 | Suga | 343/786 |
| 2004/0222934 | A1 * | 11/2004 | Wu | 343/786 |

FOREIGN PATENT DOCUMENTS

| | | |
|---|---|---|
| JP | 08-167810 | 6/1996 |
| JP | 2003-008336 | 1/2003 |
| JP | 2003-324309 | 1/2003 |

* cited by examiner

*Primary Examiner*—Shih-Chao Chen
*Assistant Examiner*—Angela M Lie
(74) *Attorney, Agent, or Firm*—Pearne & Gordon LLP

(57) ABSTRACT

A primary radiator used for a parabolic antenna including: a radiator body having a horn part provided at one end of a waveguide; and a waterproof cover covering an open end of the horn part of the radiator body, wherein a step is formed on an inner surface of the horn part of the radiator body, and a position of the step is set so that radio waves reflected on the waterproof cover are cancelled out by radio waves reflected on the step to prevent multiple reflection in the radiator body.

6 Claims, 4 Drawing Sheets

PRIMARY RADIATOR FOR PARABOLIC ANTENNA

TECHNICAL FIELD OF THE INVENTION

The present invention relates to a primary radiator for a parabolic antenna.

BACKGROUND OF THE INVENTION

There has been widely used as a satellite broadcast receiving antenna a parabolic antenna including a parabolic reflecting mirror and a primary radiator. As shown in FIG. 8, a primary radiator for a parabolic antenna used includes a radiator body 103 having a waveguide 101 and a horn part 102 provided at one end of the waveguide 101, and a waterproof cover 104 covering an open end 102*a* of the horn part 102 for preventing rainwater from entering the radiator body. In the example in FIG. 8, the waveguide 101 is a circular waveguide, and an inner surface of the horn part 102 is a conical tapered surface 102*b* having a cross section gradually increasing toward the open end. The waterproof cover 104 is formed into a cap shape, an open end thereof is a fitting portion 104*a*, and the fitting portion is fitted in a liquid-tight manner to an outer periphery of an end of the horn part 102 via an O-ring 105. The radiator body 103 and the waterproof cover 104 constitute a primary radiator 106.

In this primary radiator, the horn part 102 is placed in the vicinity of the focus position of a parabolic reflecting mirror. Radio waves from a broadcast satellite, collected in the horn part 102 by the reflecting mirror, are converged by the horn part 102 and transmitted through the waveguide 101 to an unshown down converter, and signals output from the down converter are transmitted through a coaxial cable to a tuner. The down converter converts signals in a 12 GHz band received through the primary radiator 106 to signals in a 1 GHz band in order to reduce transmission loss that occurs in the coaxial cable. Such a primary radiator is disclosed as a related art in Japanese Patent Application Laid-Open No. 8-167810.

The waterproof cover 104 is generally made of resin, and has a dielectric constant of about 2 to 4. If such a waterproof cover is attached to the open end of the horn part 102 of the primary radiator 106, multiple reflection of radio waves occurs in the primary radiator to increase reflection loss.

In order to prevent multiple reflection and reduce reflection loss, in the conventional primary radiator, a distance L from an inner surface of the waterproof cover 104 to the open end 102*a* of the horn part 102 measured on a central axis of the waveguide 101 is set to about one-half of a wavelength $\lambda$ of a radio wave to be received as shown in FIG. 8. When the radio wave to be received is 12 GHz, the distance L is about 12 mm.

When the distance L between the inner surface of the waterproof cover 104 and the open end of the horn part 102 is thus adjusted to prevent multiple reflection, it is necessary to set the distance L to be long, which causes the waterproof cover 104 to excessively project forward from the horn part 102 as shown, and snow may accumulate on the waterproof cover 104 to cause poor reception.

Thus, as disclosed in Japanese Patent Application Laid-Open No. 8-167810 and U.S. Pat. No. 6,501,432, a primary radiator has been proposed in which a projection is integrally provided on an inner surface of a waterproof cover 104 during molding of the waterproof cover 104 to prevent multiple reflection and reduce reflection loss. If the projection having an appropriate thickness is provided on the inner surface of the waterproof cover, radio waves reflected on the waterproof cover can be cancelled out by the projection, thus preventing multiple reflection and reducing reflection loss even if a distance between the waterproof cover and an open end of a horn part is short.

However, by such a method of integrally forming the projection on the inner surface of the waterproof cover, an outer surface of the waterproof cover may be dented at the projection during injection molding of the waterproof cover, and snow may accumulate on the dent to cause poor reception.

Forming the projection on the inner surface of the waterproof cover causes an intricate shape of the waterproof cover and thus an intricate structure of a die used for molding the waterproof cover, thus increasing the cost of the waterproof cover.

Further, integrally forming the projection on the inner surface of the waterproof cover causes a dielectric constant of the projection to be as high as that of the waterproof cover, thus increasing dielectric loss that occurs in the projection.

Then, as disclosed in U.S. Pat. No. 6,501,432, a primary radiator has been proposed in which a reflection preventing member constituted by a dielectric substance having a lower dielectric constant than a waterproof cover is placed in a horn to prevent multiple reflection and reduce reflection loss.

However, such a configuration requires the refection preventing member formed separately from the waterproof cover and incorporated into the radiator body, thus increasing the number of parts, causing an intricate structure, and inevitably increasing the cost.

SUMMARY OF THE INVENTION

Therefore, an object of the present invention is to provide a primary radiator for a parabolic antenna capable of reducing reflection loss without excessively projecting a waterproof cover forward from a tip of a horn part, providing a projection on an inner surface of the waterproof cover, and placing a reflection preventing member constituted by a dielectric substance in a radiator body.

In order to achieve the above described object, a primary radiator for a parabolic antenna according to the invention includes: a radiator body having a waveguide and a horn part provided at one end of the waveguide; and a waterproof cover covering an open end of the horn part, wherein a step for reducing reflection loss is provided on an inner surface of the radiator body, and a position and a size of the step are set so as to limit reflection loss that occurs in the radiator body to an allowable upper limit or lower.

By providing the step on the inner surface of the radiator body as stated above, radio waves reflected on the waterproof cover can be cancelled out by radio waves reflected on the step to prevent multiple reflection in the radiator body. Thus, the primary radiator with the reflection loss limited to the allowable upper limit or lower can be obtained without excessively projecting the waterproof cover, forming a projection inside the waterproof cover, and placing a reflection preventing member constituted by a dielectric substance in the radiator body.

In a preferable aspect of the invention, a distance between the waterproof cover and the step is set to be substantially equal to an odd multiple of 180° in terms of a phase angle of a radio wave propagating in the radiator body.

The step may be provided on an inner surface of a tapered part of the radiator body, or an inner surface of the waveguide.

Also, the step may be provided on a border between the tapered part of the radiator body and the waveguide.

BRIEF DESCRIPTION OF THE DRAWINGS

The above and other objects and features of the invention will be apparent from the detailed description of the preferred embodiments of the invention, which are described and illustrated with reference to the accompanying drawings, in which.

DETAILED DESCRIPTION OF THE PREFERRED EMBODIMENTS

Figure 1:
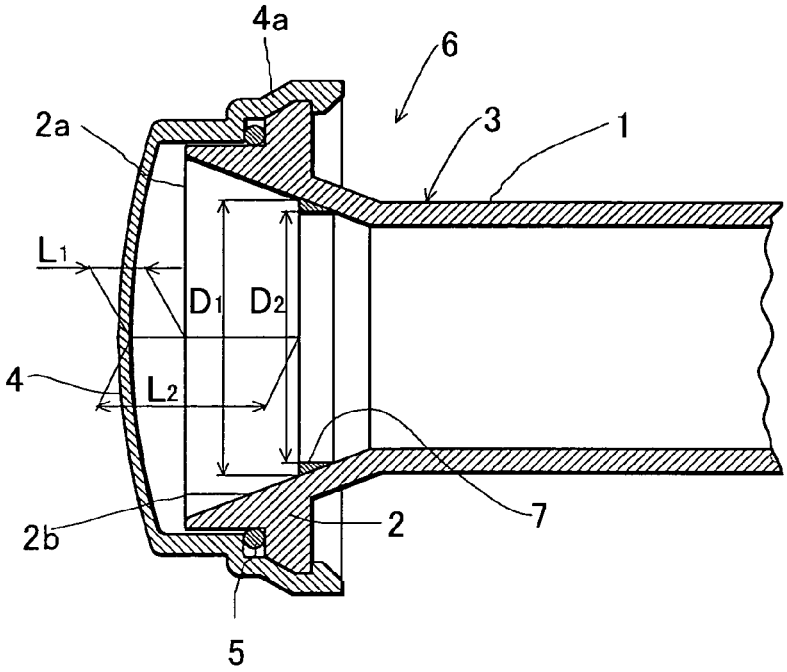
FIG. 1 is a vertical sectional view of a configuration of essential portions of a first embodiment of a primary radiator according to the invention.

FIG. 1 shows a first embodiment of the invention. In FIG. 1, a reference numeral 1 denotes a circular waveguide, and a reference numeral 2 denotes a horn part provided at one end of the waveguide 1. In this embodiment, the waveguide 1 and the horn part 2 are made of aluminum. The horn part 2 is integrally formed at one end of the waveguide 1, and an inner surface of the horn part 2 is a conical tapered surface 2*b* having a cross section gradually increasing toward an open end 2*a* thereof. The waveguide 1 and the horn part 2 constitute a radiator body 3 having an inner surface rotationally symmetric with respect to a central axis. The radiator body is made by die casting.

A reference numeral 4 denotes a waterproof cover covering the open end 2*a* of the horn part 2 for preventing rainwater from entering the radiator body 3. The waterproof cover 4 is made of ABS resin or polypropylene resin so as to have a uniform thickness. The thickness of the waterproof cover 4 is set to be sufficiently shorter than a wavelength of a radio wave to be received. The waterproof cover 4 is formed into a cap shape, a part thereof closer to the open end is a fitting portion 4*a*, and the fitting portion is fitted in a liquid-tight manner to an outer periphery of an end of the horn part 2 via an O-ring 5. The radiator body 3 and the waterproof cover 4 constitute a primary radiator 6.

In such a primary radiator, as radio waves reflected on the waterproof cover 4 and traveling to the waveguide increase, standing waves (multiple reflection) produced in the primary radiator increase to increase reflection loss and reduce intensity of signals input to a down converter. In order to reduce the reflection loss, it is necessary to prevent the radio waves reflected on the waterproof cover 4 from propagating to the waveguide 1 and prevent the standing waves from being produced in the primary radiator.

In the invention, a step 7 for reducing reflection loss is provided on an inner surface of the radiator body 3, closer to the waveguide 1 than the open end 2*a* of the horn part 2. The step 7 is a part for varying an inner diameter of the radiator body stepwise, and is constituted by a conductive member in the same manner as the radiator body 3. The step 7 used in the embodiment is constituted by a ring-shaped member in which an inner peripheral surface has a uniform inner diameter along an axis, an outer peripheral surface is a tapered surface inclined at the same angle as a taper of the inner surface of the horn part 2, and the outer peripheral surface is bonded to the inner peripheral surface of the horn part 2. The step 7 is formed to be rotationally symmetric with respect to the central axis of the radiator body.

In the invention, a position and a size of the step 7 are set so as to prevent standing waves from being produced in the radiator body 3 and limit reflection loss to an allowable upper limit or lower.

In the primary radiator of the embodiment, the waterproof cover 4 acts as a capacitive short circuit, and the step 7 provided on the inner surface of the radiator body 3 acts as an inductive short circuit. In the primary radiator 6, there are radio waves propagating from the waterproof cover 4 through the waveguide 1 to an unshown down converter, and radio waves reflected on an end opposite from the horn part 2 of the waveguide 1 and traveling to the waterproof cover, as well as radio waves reflected on the step 7, in the process of traveling from the waterproof cover to the waveguide, and returning to the waterproof cover 4.

Then, a distance L2 between an inner surface of the waterproof cover 4 and the step 7 is set so that a phase difference between the radio waves reflected on the waterproof cover 4 and propagating to the waveguide 1 and the radio waves reflected on the step 7 and propagating to the waterproof cover 4 is about 180°, and a size of the step 7 at each part (a maximum outer diameter D1 and an inner diameter D2) is set so as to reflect an appropriate amount of radio waves on the step 7. This allows the radio waves reflected on the waterproof cover 4 and the radio waves reflected on the step 7 to be canceled out each other, thus preventing the radio waves reflected on the waterproof cover 4 from traveling to the waveguide 1 to produce standing waves in the radiator body, and reducing reflection loss that occurs in the primary radiator.

According to the invention, in order that the radio waves reflected on the waterproof cover 4 and the radio waves reflected on the step 7 are canceled out each other, the distance L2 between the inner surface of the waterproof cover 4 and the step 7 is set to be substantially equal to an odd multiple of 180° in terms of a phase of the radio wave propagating in the radiator body. Specifically, the distance L2 between the waterproof cover and the step measured along the central axis of the radiator body is set so that a difference between a phase of the radio wave at the inner surface of the waterproof cover 4 and a phase of the radio wave at the step 7 (at an end surface of the step 7 facing the waterproof cover) is substantially equal to the odd multiple of 180°. The size (the maximum outer diameter D1 and the inner diameter D2) of the step 7 is set so that the amount of radio waves reflected on the step 7 is substantially equal to the amount of radio waves reflected on the waterproof cover 4.

In the horn part 2, a guide wavelength continuously varies along an axis of the horn part 2, and thus a phase angle at each end of the horn part 2 is calculated by integrating along the axis the phase angle of the radio wave at each position in the horn portion.

This embodiment is based on receiving radio waves of a 12 GHz band (11.7 GHz to 12.7 GHz) transmitted from a broadcast satellite. In this case, a preferable inner diameter of the open end 2*a* of the horn part 2 of the radiator body 3 is about 30 mm. In this embodiment, a dielectric constant $\in r$ of resin that forms the waterproof cover 4 is 2.6, and a thickness of the waterproof cover 4 is set to about 0.8 mm. Further, a distance L1 between the inner surface of the waterproof cover 4 and the open end of the horn part 2 is set to 5 to 6 mm. In a conventional primary radiator, a distance L1 between an inner surface of a waterproof cover and an open end of a horn part 2 is set to about 12 mm.

A test shows that, according to the invention, the distance L1 between the inner surface of the waterproof cover and the open end 2*a* of the horn part 2 is set to a significantly smaller value (5 to 6 mm) than a value required by the conventional primary radiator (12 mm) to limit the reflection loss within an allowable range.

Figure 2:
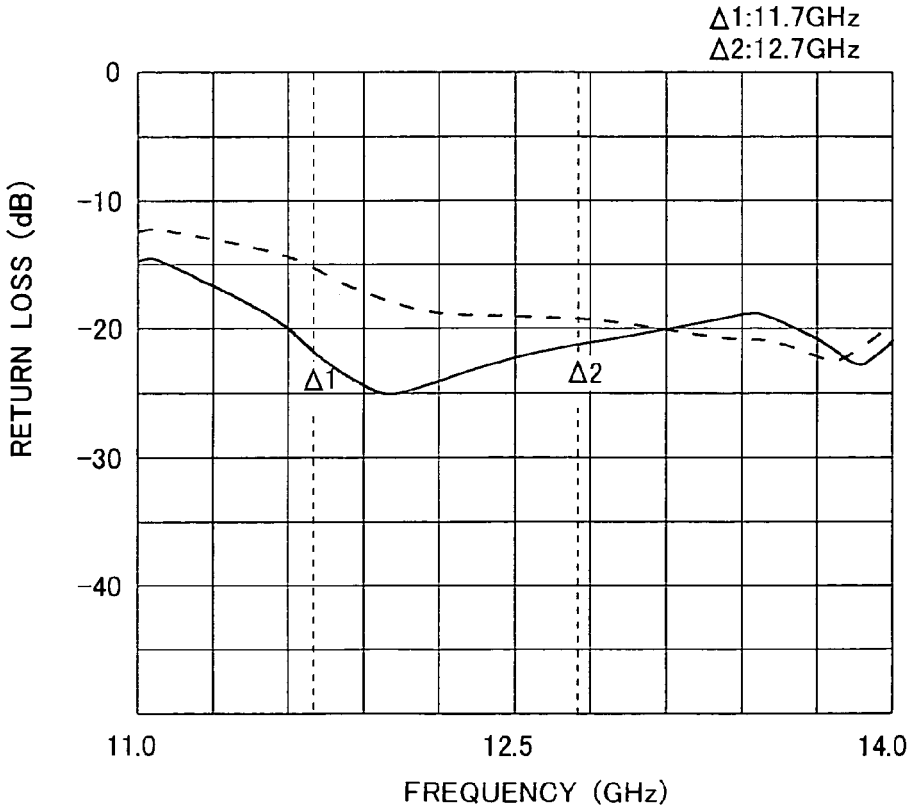
FIG. 2 is a graph comparing reflection loss that occurs in the primary radiator of the first embodiment, and reflection loss that occurs in a primary radiator of a comparative example with a step removed from the primary radiator in FIG. 1.
Figure 3:
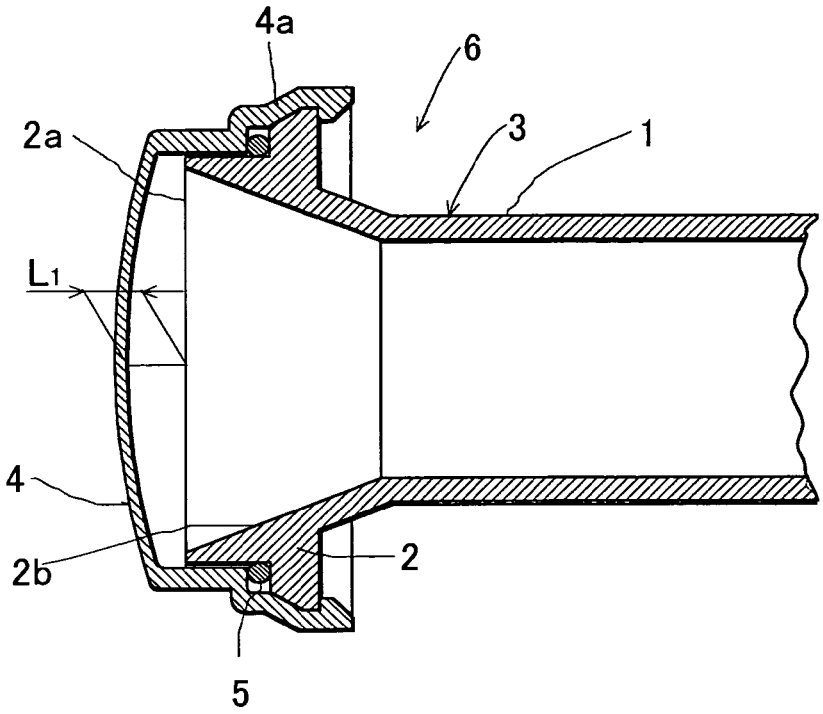
FIG. 3 is a vertical sectional view of a primary radiator for a parabolic antenna of the comparative example.

FIG. 2 is a graph showing measurement results of reflection loss properties of a primary radiator 6' of the comparative example in FIG. 3, and the primary radiator 6 according to the embodiment of the invention. The primary radiator 6' of the comparative example in FIG. 3 is the primary radiator 6 according to the embodiment in FIG. 1 with the step 7 removed. Other parts are configured the same as the embodiment in FIG. 1.

In FIG. 2, a solid curve shows a reflection loss property indicating reflection loss (return loss) of the embodiment of the invention in FIG. 1 with respect to frequencies, and a dashed curve shows a reflection loss property of the comparative example in FIG. 3. In FIG. 2, reference numerals Δ1 and Δ2 indicate a lower limit (11.7 GHz) and an upper limit (12.7 GHz), respectively in a receiving band.

The return loss indicates in decibels a ratio of radio waves that have been lost by reflection and not received to radio waves having entered the primary radiator, and the return loss in the case where all the emitted radio waves are lost by reflection is 0 dB, and the return loss in the case where all the emitted radio waves are received is $-\infty$ dB. An allowable upper limit of reflection loss of a primary radiator used for a satellite broadcast receiving parabolic antenna is generally −20 dB in return loss.

As is apparent from FIG. 2, in the radio wave receiving band (11.7 GHz to 12.7 GHz) of a satellite broadcast, the return loss of the primary radiator of the comparative example in FIG. 3 is about −15 dB, while according to the embodiment of the invention in FIG. 1, the return loss is improved to about −21 dB, thus allowing the reflection loss to be limited to the allowable upper limit or lower.

The test result described above shows that by providing the step on the inner surface of the radiator body as in the invention, a primary radiator sufficient for practical applications can be obtained without excessively projecting the waterproof cover.

In FIG. 2, the comparative example in FIG. 3 shows a superior reflection loss property in some frequency bands, but such frequency bands in which the comparative example shows the superior reflection loss property is outside a satellite broadcast receiving band, which has no problem.

On the actual design, the amount of radio waves reflected on the waterproof cover slightly varies depending on the dielectric constant, the thickness, the size, the shape or the like of the waterproof cover 4, and thus the size and the position of the step 7 are adjusted based on the test so as to minimize the reflection loss in the receiving band (11.7 GHz to 12.7 GHz).

As described above, according to the invention, the step 7 is provided on the inner surface of the radiator body 3, and the radio waves are reflected on the step to cancel out the radio waves reflected on the waterproof cover 4, thus reducing the reflection loss without a long projection of the waterproof cover 4.

The configuration as described above eliminates the need for forming a projection on the inside of the waterproof cover 4, and thus the waterproof cover may have a uniform thickness to prevent an outer surface of the waterproof cover from being dented during injection molding thereof.

As described above, the step is provided on the inner surface of the radiator body, and the reflection waves on the waterproof cover are canceled out by the radio waves reflected on the step to reduce the reflection loss, which eliminates the need for providing in the radiator body a reflection preventing member constituted by a dielectric substance, thus reducing the reflection loss without increasing dielectric loss or costs.

Further, as described above, if the radiator body 3 is formed to have the inner surface rotationally symmetric with respect to the central axis, and the step 7 is formed to be rotationally symmetric with respect to the central axis of the radiator body, a circularly polarized wave axial ratio (a ratio between a maximum value and a minimum value of a receiving output when a primary radiator is rotated around a central axis thereof to have a 90° different attachment angle) may be set to 1, and thus a predetermined receiving output can be obtained without being affected by an attachment angle of the primary radiator.

Figure 4:
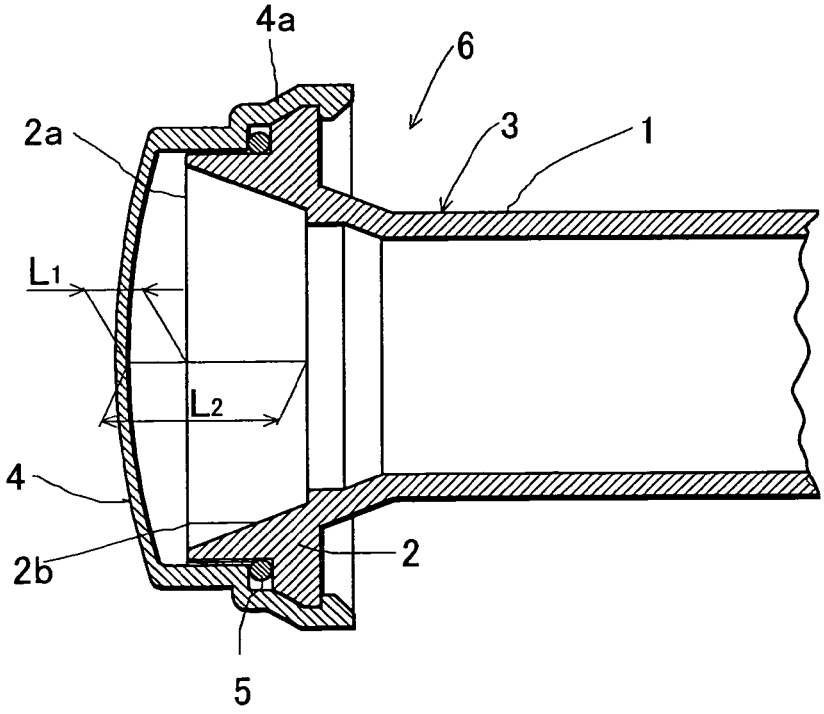
FIG. 4 is a vertical sectional view of a configuration of essential portions of a second embodiment of a primary radiator for a parabolic antenna according to the invention.

FIG. 4 is a vertical sectional view of a second embodiment of a primary radiator for a parabolic antenna according to the invention. In this embodiment, when a radiator body 3 constituted by a waveguide 1 and a horn part 2 is made, a step 7 is integrally formed on an inner surface of the horn part 2. Materials, shapes, positions, sizes or the like of the waveguide 1 and the horn part 2 are the same as in the embodiment in FIG. 1.

When the step 7 is integrally provided on the inner surface of the horn part 2, the step 7 can be formed simply by forming a die part for the step 7 in part of a die used for die casting the radiator body, thus simplifying manufacture of the radiator body having the step.

Figure 5:
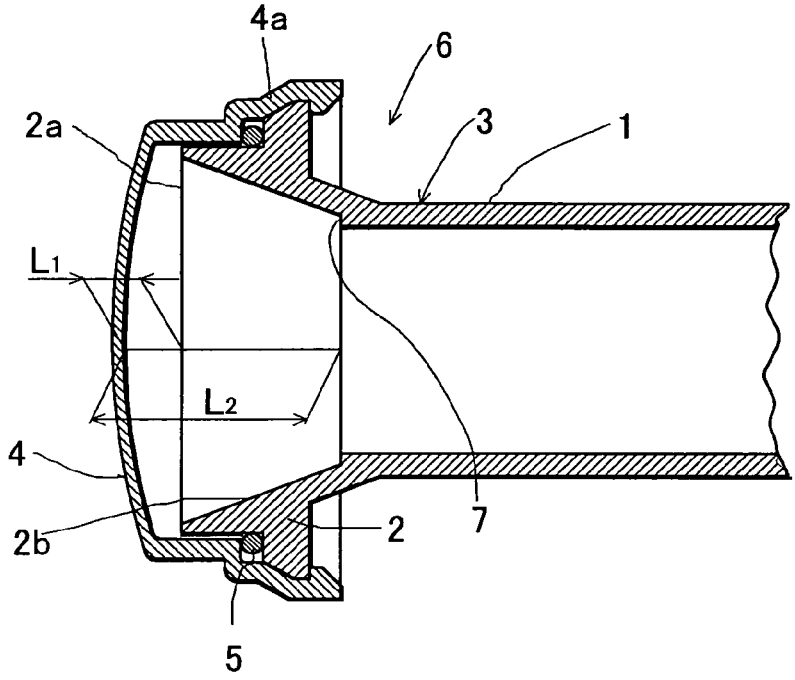
FIG. 5 is a vertical sectional view of a configuration of essential portions of a third embodiment of a primary radiator for a parabolic antenna according to the invention.

FIG. 5 is a vertical sectional view of a third embodiment of a primary radiator for a parabolic antenna according to the invention. In this embodiment, a step 7 is integrally provided with a waveguide 1 in a border between the waveguide 1 and a horn part 2 of a radiator body 3. Other points are the same as in the embodiment in FIG. 1.

When the step 7 is thus provided in position, a distance L1 between an inner surface of a waterproof cover 4 and an open end 2*a* of the horn part 2 is adjusted so as to adjust a distance between the inner surface of the waterproof cover 4 and the step 7 to be substantially equal to an odd multiple of 180° in terms of a phase angle of a radio wave propagating in the radiator body, and a size of the step 7 is appropriately adjusted so as to allow radio waves reflected on the waterproof cover to be cancelled out by radio waves reflected on the step 7. Even in such a configuration, reflection loss can be reduced without a long distance L1 between the inner surface of the waterproof cover 4 and the open end 2*a* of the horn part 2.

When shipping the manufactured primary radiator, it is necessary to test whether the property of the primary radiator meets standards. For a test of the primary radiator, it is necessary to insert an adaptor waveguide into the waveguide 1 and bring one end of the adaptor waveguide into contact with the border between the waveguide 1 and the horn part 2. In a conventional primary radiator, a border between a waveguide 1 and a horn part 2 is one loop line, and thus an adaptor waveguide and the border are likely to be in no contact with each other in some spots when the adaptor waveguide is inserted in an inclined manner.

On the other hand, when the step is provided in the border between the waveguide 1 and the horn part 2 as shown in FIG. 5, one end of the adaptor waveguide is brought into contact with the step 7 to allow surface contact of the border between the waveguide and the horn part of the primary radiator with the adaptor waveguide, thus preventing reduction in measurement accuracy caused by poor contact between the adaptor waveguide and the primary radiator.

Figure 6:
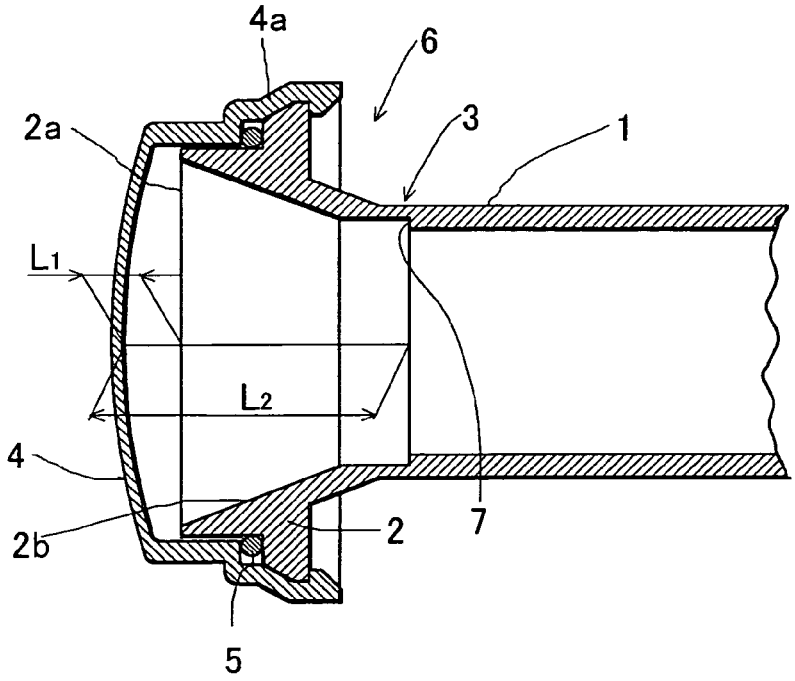
FIG. 6 is a vertical sectional view of a configuration of essential portions of a fourth embodiment of a primary radiator for a parabolic antenna according to the invention.

FIG. 6 shows a fourth embodiment of the invention. In the first to third embodiments, the step is formed on the inner surface of the horn part 2 of the radiator body or on the border between the waveguide and the horn part, but in the fourth embodiment in FIG. 6, a step 7 is provided on an inner surface of a waveguide 1. Also when the step 7 is thus provided, a distance L2 between an inner surface of a waterproof cover 4 and the step 7 is set to be substantially equal to an odd multiple of 180° in terms of a phase of a radio wave so that radio waves reflected on the waterproof cover 4 and radio waves reflected on the step 7 are canceled out each other, and a size of the step 7 (a maximum outer diameter D1 and an inner diameter D2) is set so that the amount of radio waves reflected on the step 7 is substantially equal to the amount of radio waves reflected on the waterproof cover 4, thus reducing the reflection loss.

Figure 7:
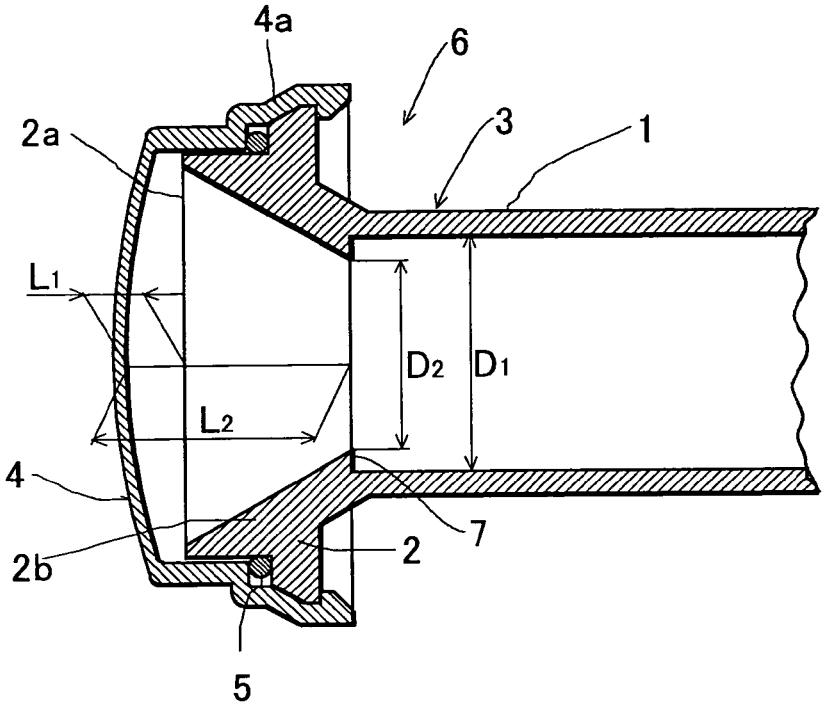
FIG. 7 is a vertical sectional view of a configuration of essential portions of a fifth embodiment of a primary radiator for a parabolic antenna according to the invention.
Figure 8:
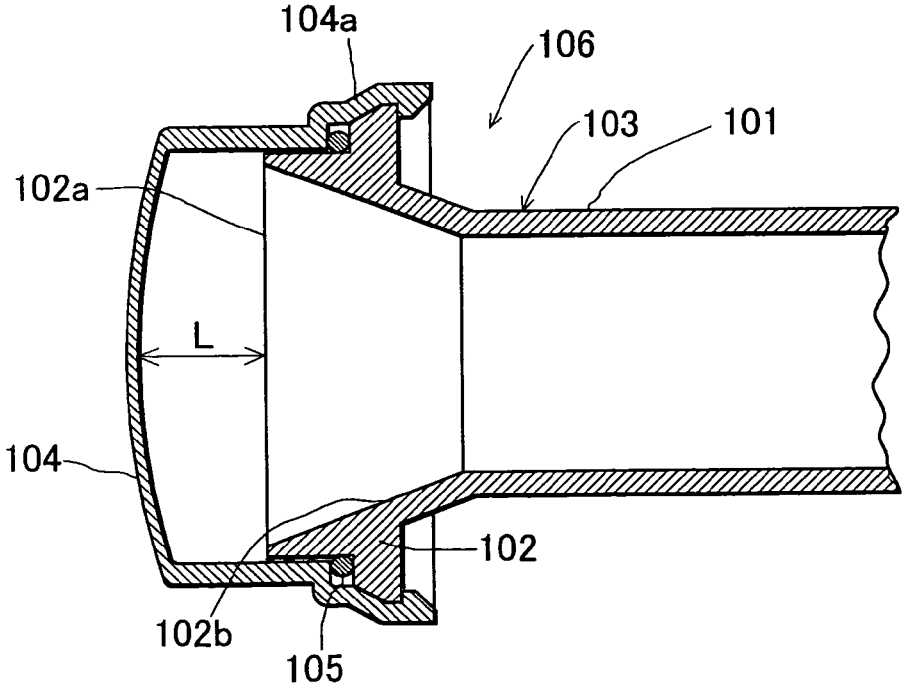
Fig. 8 Prior Art
FIG. 8 is a vertical sectional view of a configuration of essential portions of a conventional primary radiator for a parabolic antenna.

FIG. 7 shows a fifth embodiment of the invention. In the first to fifth embodiments, the step 7 is provided with a step part (a surface orthogonal to the central axis of the waveguide) facing the open end of the horn part 2, but the step 7 may be provided so as to abruptly change impedance at the step and reflect radio waves propagating from the waterproof cover 4 to the waveguide 1, and thus the step 7 may be provided with the step part facing the waveguide 1 as shown in FIG. 7.

In the above description, the radio waves in the 12 GHz band are received, but of course, the invention may be applied to a primary radiator for a parabolic antenna that receives radio waves in other frequency bands.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. A primary radiator for a parabolic antenna comprising:

a radiator body having a waveguide and a horn part provided at one end of said waveguide; and a waterproof cover covering an open end of said horn part, wherein a step for reducing reflection loss is provided on an inner surface of said radiator body, and a position and a size of said step are set so as to limit reflection loss that occurs in said radiator body to an allowable upper limit or lower, wherein a distance between said waterproof cover and said step is set to be substantially equal to an odd multiple of 180° in terms of a phase angle of a radio wave propagating in said radiator body.

2. The primary radiator according to claim 1, wherein said step is provided on an inner surface of said horn part.

3. The primary radiator according to claim 1, wherein said step is provided on a border between said horn part and the waveguide.

4. The primary radiator according to claim 1, wherein said step is provided on an inner surface of said waveguide.

5. The primary radiator according to claim 1, wherein said step is integrally formed on said radiator body.

6. The primary radiator according to claim 1, wherein said radiator body is formed to have an inner surface rotationally symmetric with respect to a central axis, and said step is formed to be rotationally symmetric with respect to the central axis of said radiator body.

* * * * *